United States Patent [19]

Faulconer et al.

[11] Patent Number: 4,523,914

[45] Date of Patent: Jun. 18, 1985

[54] CONFORMABLE BUOYANCY COMPENSATOR

[75] Inventors: Mark Faulconer, Costa Mesa; Allan R. Langton, Santa Ana, both of Calif.

[73] Assignee: U.S.D. Corp, Santa Ana, Calif.

[21] Appl. No.: 461,180

[22] Filed: Jan. 26, 1983

[51] Int. Cl.[3] ..... B63C 9/16

[52] U.S. Cl. ..... 441/108; 441/88; 441/106

[58] Field of Search ..... 441/90–92, 441/94–96, 88, 89, 97–99, 100, 101, 106–108, 111, 112, 114–119; 405/186; 128/202.14

[56] References Cited

U.S. PATENT DOCUMENTS

| | | | |
|---|---|---|---|
| 261,940 | 8/1882 | Maynard | 441/111 |
| 1,208,198 | 12/1916 | Penksa | 441/102 |
| 2,331,301 | 10/1943 | Brown | 441/111 |
| 2,535,874 | 12/1950 | Starn | 441/112 |
| 3,095,568 | 6/1963 | Aine et al. | 441/94 |
| 3,436,777 | 4/1969 | Greenwood | 441/108 |
| 3,470,570 | 10/1969 | Christiansen | 405/186 |
| 3,536,071 | 10/1970 | Ferrando | 441/118 |
| 4,045,835 | 9/1977 | Flam | 441/106 |
| 4,054,132 | 10/1977 | Deeds | 441/96 |
| 4,114,389 | 9/1978 | Bohmrich | 405/186 |
| 4,416,641 | 11/1983 | Spinosa | 441/108 |

*Primary Examiner*—Trygve M. Blix
*Assistant Examiner*—C. T. Bartz
*Attorney, Agent, or Firm*—George F. Bethel; Patience K. Bethel

[57] ABSTRACT

The following specification sets forth a conformable buoyancy compensator that conforms to a user's body in a uniform manner during use. The buoyancy compensator incorporates an interior bladder having a plurality of heat sealed pleats or insets around the shoulder area in order to provide conformity of the buoyancy compensator to a user's body. The bladder further comprises interior reinforced gussets that retain the conformation of the bladder in a plurality of air channels or pockets that conform to the frontal areas of a user's body. The arm openings are free and open for a user to extend one's arms. Between the front and back portions of the air channels are a plurality of side panels that can be made of spandex, elastic, or can be configured of suitable strapping. The buoyancy compensator has vents. Vented pockets are provided for the receipt of a second stage regulator therein, as well as providing for other specific storage of items used by a diver. The combination of notches, pleats, and insets that have been heat set into the shoulder portion in combination with the heat set reinforced gussets within the bladder in the frontal and rear portion of the buoyancy compensator allow for a conformable configuration that conforms to the body. The foregoing configuration eliminates bulges and undue expansion of the buoyancy compensator into an extended relationship as is known in the prior art.

7 Claims, 9 Drawing Figures

CONFORMABLE BUOYANCY COMPENSATOR

BACKGROUND OF THE INVENTION

1. Field of the Invention

The field of this invention is within the underwater diving art. More specifically, it is within the diving art as it pertains to maintaining a desired buoyancy of a diver.

In particular, it involves the utilization of a buoyancy compensator that has been specifically configured for use by a diver in an enhanced manner.

2. The Prior Art

The prior art of buoyancy compensators includes a first series of buoyancy compensators that were made from a life jacket type of configuration. In such buoyancy compensators, a life jacket having a bladder therein was adjusted to provide for appropriate buoyancy of a diver. Such buoyancy compensators usually were configured of a yoke conformation that went over a user's neck and provided for lift on a user's chest.

It was found over the years that such a configuration generally tilted a diver into an inappropriate angle. Accordingly, buoyancy was also later provided at various other portions on a diver's body. The provision of such buoyancy around a diver led to the utilization of bladders and buoyancy compensators that surrounded a diver's body in various areas within the chest region and around his neck.

During the development and utilization of such buoyancy compensators, they were oftentimes filled through oral inflation means. In addition thereto, a power inflation means was sometimes used by means of coupling the first stage pressure that had been regulated by the first stage regulator to a hose. The hose was then capable of being connected to the buoyancy compensator by a quick fitting connection that could be fitted upon, or disconnected from the buoyancy compensator input fitting in a facile manner.

Upon connection to the buoyancy compensator input fitting, a valve means could be utilized to fill the buoyancy compensator from the pressure within the hose connected from the first stage regulator carrying regulated intermediate pressure.

All of the foregoing devices generally comprised the utilization of a bladder internally of a textile material. The bladder was filled through the foregoing means and usually expanded in an awkward and inordinate manner.

For instance, during the inflation of such buoyancy compensators, the bladder over a user's neck and chest area expanded dramatically. This expansion created the impression of a large Mae West type of life preserver on the top of one's chest. This particular configuration created a cumbersome orientation of the buoyancy compensator on a user's chest, and improper lift to a diver's body.

In addition to the foregoing large protruding areas on one's chest, the remaining portion of the buoyancy compensator was oftentimes uncomfortable. For instance, such buoyancy compensators did not have freedom of movement of one's arms within the openings of the buoyancy compensator. Also, the buoyancy compensator could not expand and contract with respect to a user's body in a facile manner.

Furthermore, when the buoyancy compensator was over one's shoulders, a substantial amount of misfitting and bulbous material was encountered. For instance, such buoyancy compensators were generally crimped and did not fit conformably over a user's shoulders. The rear portion of the buoyancy compensator often expanded so as to create a uncomfortable situation for a diver in the area adjacent the backpack and his neck.

All of the foregoing deficiencies of the prior art as to expansion of large protruding areas in the front, a binding of a user's shoulders, an improper fitting of the buoyancy compensator, and a blowing up or extended relationship of the buoyancy compensator tended to create problems. This particular invention overcomes the foregoing deficiencies in great measure, by providing a conformable buoyancy compensator.

The buoyancy compensator of this invention provides for conformation to a user's chest and body configuration. The conformation is enhanced within the chest area by preventing the protruding enlarged areas that are inherent within prior art buoyancy compensators. Such protruding prior art configurations are eliminated in great measure by the provision of gussets or ribs and reinforcing within the bladder in the chest and back area of the buoyancy compensator.

The problem with regard to a user's shoulder area puffing up and extending around a user's neck has been solved by this invention having a plurality of heat set pleats, inserts, or notches within the shoulder area. These heat set pleats create a tucked relationship of the bladder within the shoulder area so that the bladder of the buoyancy compensator is configured around one's shoulders.

In addition to the foregoing features, the buoyancy compensator incorporates a series of side panels to allow for freedom of movement of a diver within the shoulder and arm area. This freedom of movement is further enhanced by expandable straps that can be stretched to allow for various movements of the diver within the buoyancy compensator.

Finally, a series of pockets and other enhancements of the invention are such that they allow for not only freedom of movement of the diver using the buoyancy compensator, but also storage and utilization of diving equipment while diving in a most efficacious manner. As a consequence, the invention should be read broadly in light of the following specification, claims, and summary of the invention, inasmuch as it is a substantial step over the prior art of bouyancy compensators.

SUMMARY OF THE INVENTION

In summation, this invention comprises a conformable buoyancy compensator which tends to conform to a user's chest and back regions, as well as providing for conformation in the shoulder area, through a novel bladder configuration.

More particularly, the invention incorporates a buoyancy compensator having an outer textile material and a bladder therein. Both the outer material and bladder can be substituted by one sealed material substituted for both the outer, and the inner bladder material.

The bladder has a series of gussets in the front and the back which divide off the bladder into a conformable pair of channels or air bags. The conformable channels with the gussets tend to hold the back and front portions of the buoyancy compensator into snug relationship on a user's chest, rather than providing for the substantial extensions of the chest bladder areas as known in the prior art. This thereby prevents unwarranted expansion and extension of the buoyancy compensator into an expanded extended relationship.

The shoulder area incorporates notches, pleats or insets which allow for the shoulder area of the buoyancy compensator to conform to a user's shoulder. The particular notches or insets provide for a rounded smooth relationship of the bladder over a user's shoulders. This creates a more conformable relationship by preventing the bladder from extending up over a user's neck, which created a discomfort annd immobility to a user's head and neck region.

The buoyancy compensator provides for increased shoulder and arm mobility by having a pair of pleated stretchable side panels or waistbands on either side. This allows for the diver to extend his arms and provide for greater mobility in the arm region.

Finally, the invention provides for expandable pockets, and drains throughout the outer material so as to enhance the overall life and utilization of the buoyancy compensator, as well as the utilization thereof. One of these pockets has a side wall that is diminished in height so as to accommodate a second stage or demand regulator referred to as an octopus. The hose to the demand regulator is allowed to extend over the wall for storage of the regulator with the hose in the pocket when connected. As a consequence, this invention should be read broadly in light of the fact that it is an improved buoyancy compensator with the enhanced features as enunciated hereinbefore and which shall be set forth hereinafter.

DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
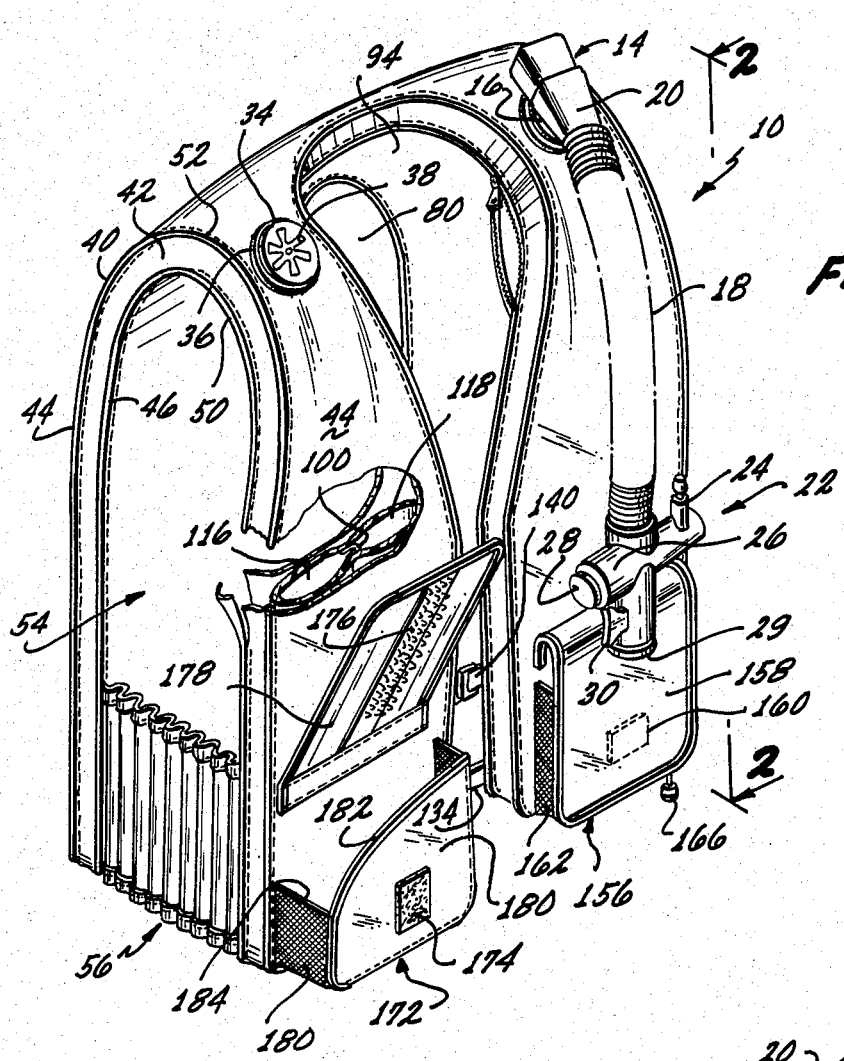
FIG. 1 shows a perspective view of the buoyancy compensator of this invention looking from the frontal region thereof and wherein a portion has been fragmented and sectioned to show the bladder with the gussets therein.
Figure 3:
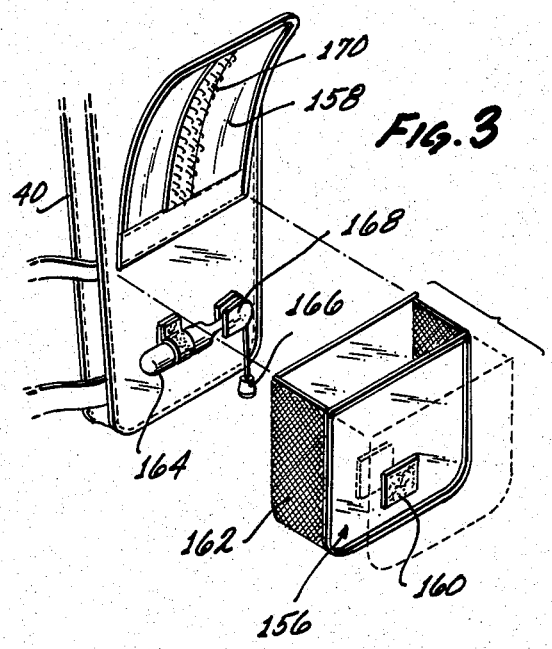
FIG. 3 shows a view of the pocket of the buoyancy compensator when looking at the right hand side thereof.
Figure 2:
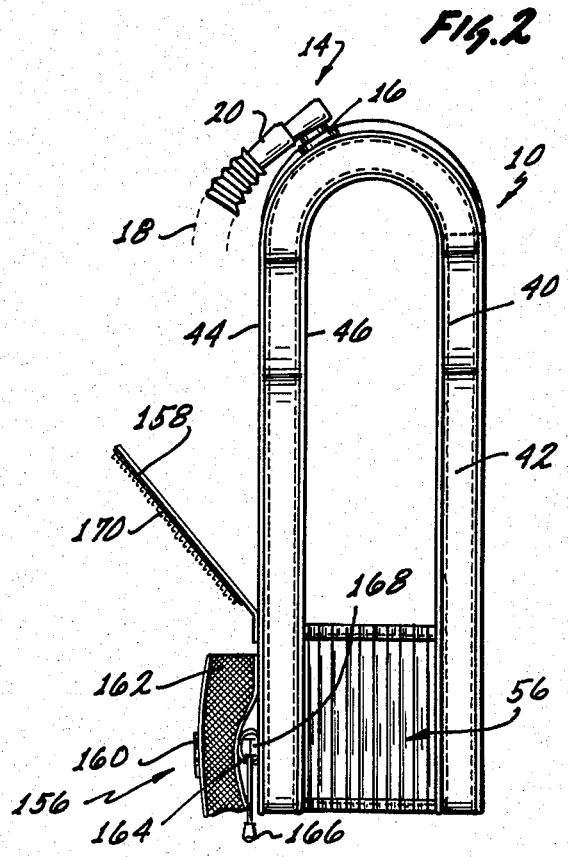
FIG. 2 shows a side elevation view of the buoyancy compensator looking in the direction of lines 2—2 of FIG. 1.
Figure 4:
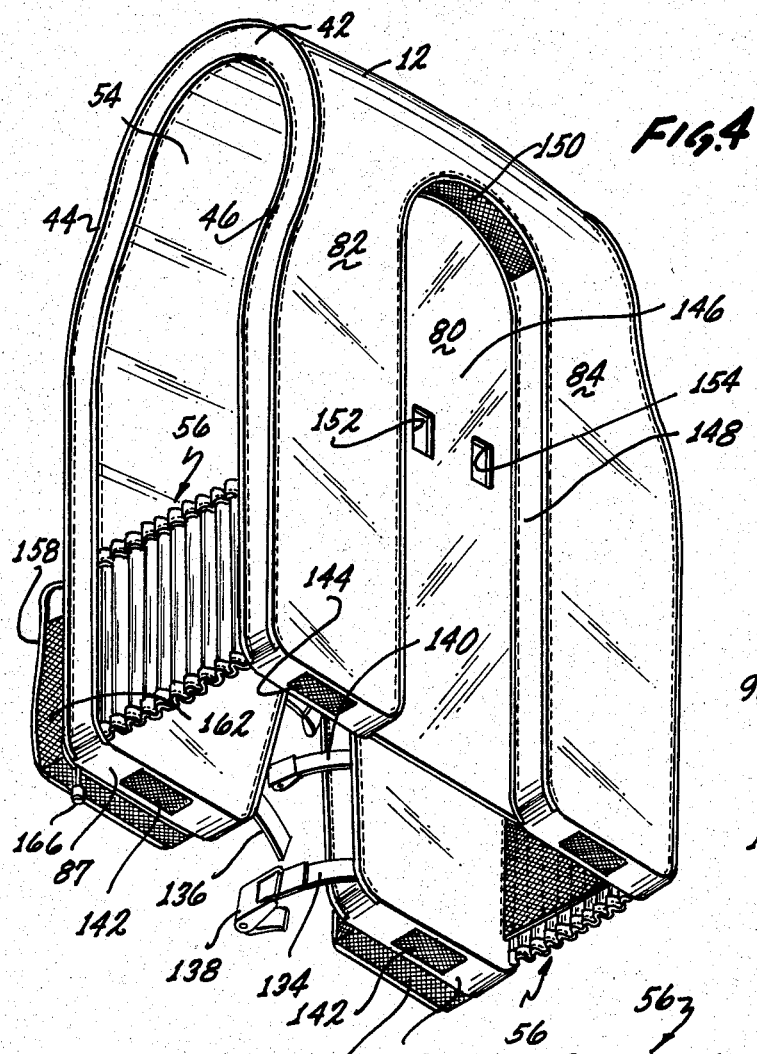
FIG. 4 shows a perspective view of the back of the buoyancy compensator where the backpack is attached.
Figure 6:
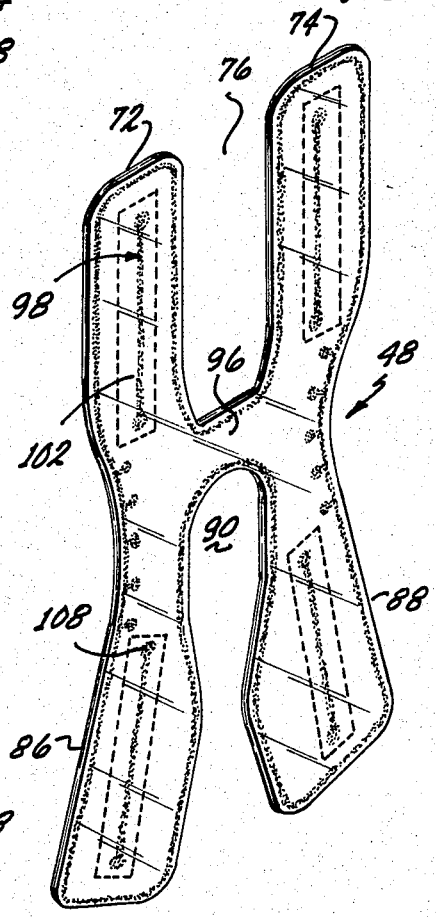
FIG. 6 shows the bladder portion of the buoyancy compensator laid out in a flattened configuration.
Figure 5:
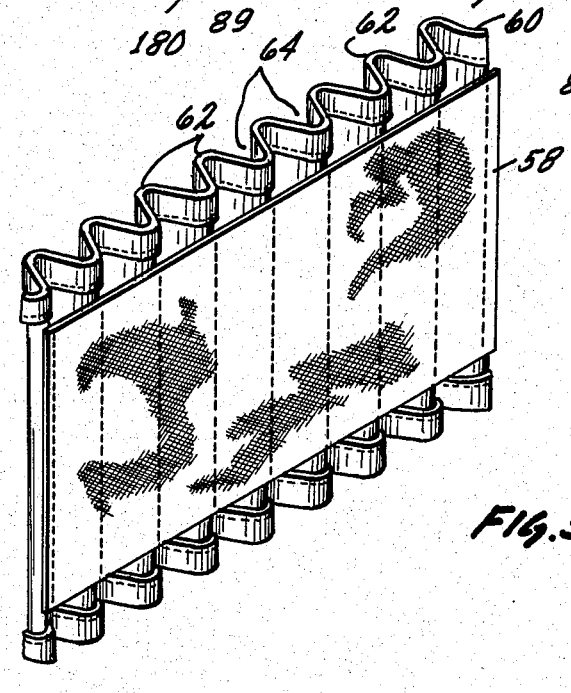
FIG. 5 shows the expandable side panel as seen along the sides of the buoyancy compensator.
Figure 7:
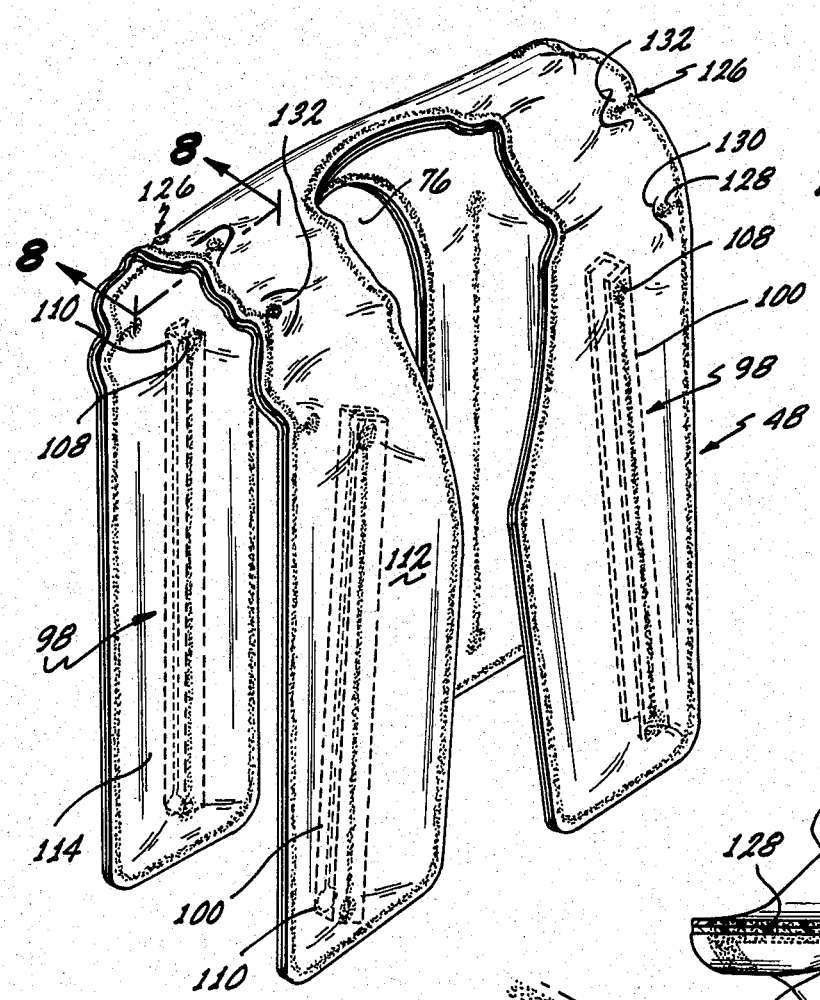
FIG. 7 shows the bladder of the buoyancy compensator that would fit internally of the outer material holding the bladder.
Figure 8:
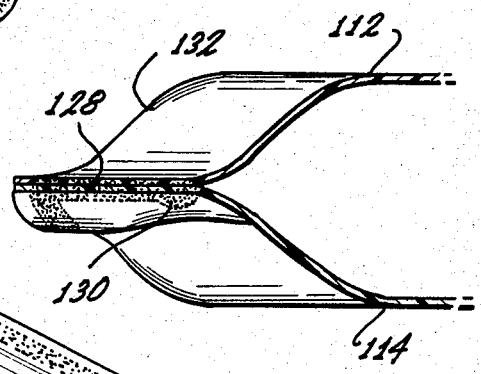
FIG. 8 shows a view of the heat set pleats as seen in the direction of lines 8—8 of FIG. 7; and, FIG. 9 shows a view of the seal ribs and gussets within the bladder that provide the conformable effect in the front and rear of the buoyancy compensator.
Figure 9:
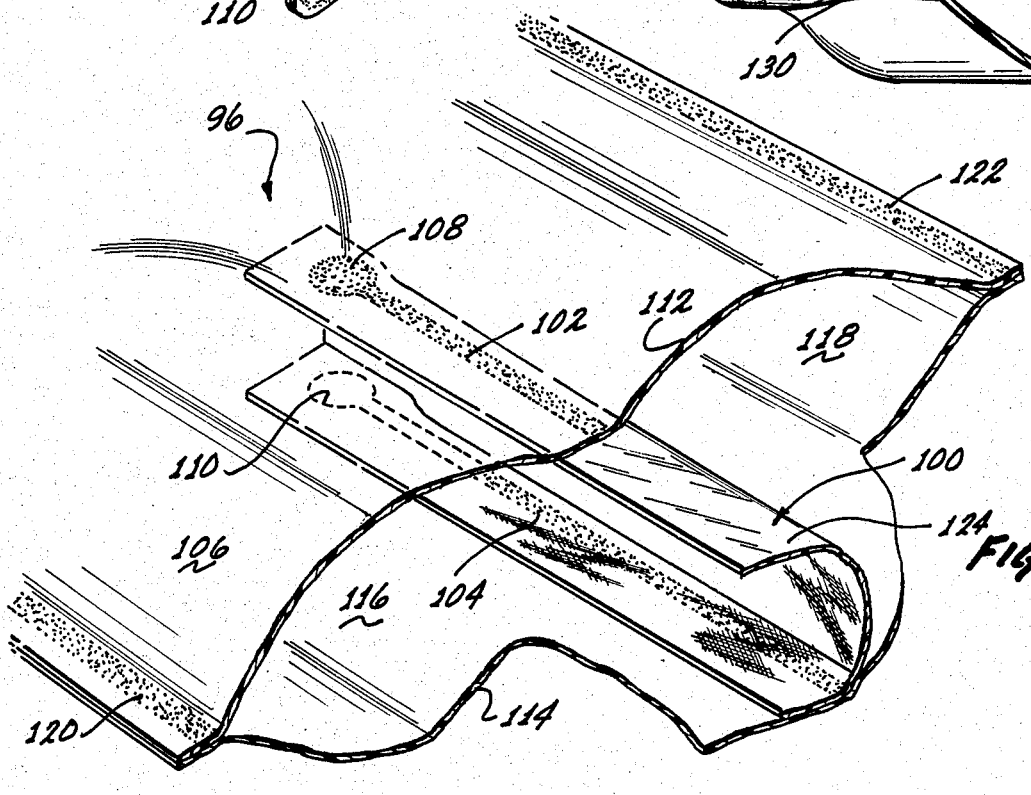

Looking specifically at FIG. 1, it can be seen wherein a buoyancy compensator vest 10 has been shown. The buoyancy compensator vest 10 is comprised of an outer material 12 that can be seen in the cutaway view of FIG. 4 and in the remaining views. The outer material can be formed from a canvas type of material, a plastic type of material, or any other type of textile material. Also, a urethane coated nylon fabric, or other nylon fabrics that can be woven or unwoven, can be utilized. Regardless of the foregoing, the outer material 12 does not necessarily have to be expandable or provide the function of a bladder, except in another embodiment that shall be detailed hereinafter.

The vest 10 incorporates an inflator fixture 14. The inflator fixture 14 is connected to an inlet fitting 16 which passes through the outer fabric 12 into a bladder, as will be detailed hereinafter. The fixture 14 connected to the inlet fitting 16 can be of any suitable configuration, so long as a conduit is established, as will be explained hereinafter. In effect, the fitting 16 can be a plastic flange or other sealed device into the material 12 and thence passing into the bladder as detailed hereinafter.

The inlet fitting and fixture are designed to conduct air through an inflator tube or hose 18. The inflator tube 18 comprises a tubular member having one end attached to the fixture 14 by means of an extended plastic conduit 20, and at the other end to an inflator mechanism 22.

The inflator mechanism 22 can be connected to an intermediate pressure line at a quick disconnect fitting 24. The quick disconnect fitting 24 attaches to a hose that is not shown but can be connected to an intermediate pressure source such as that provided from a first stage regulator attached to the backpack and tank used for self contained underwater breathing apparatus. Inflation can then take place by pushing button 28 connected to a valve in the inflator body 26.

The inflator mechanism 22 also has a second valve in the body 26. The inflator body 26 includes a valve button 29 that allows the user to orally inflate the bladder by the inflator tube 18. This is accomplished by pressing the button 29 so that the valve body 26 can be utilized to cause air to flow from a mouthpiece 30 through the inflator tube 18 into the buoyancy compensator.

From the foregoing it can be seen that the inflator mechanism 22 can be used to inflate the buoyancy compensator through the tube 18 by either using the intermediate pressure delivered through quick disconnect fitting 24 that is valved by valve button 28, or in the alternative, inflation can take place through the mouthpiece 30. When inflation takes place through the mouthpiece 30, the valve button 29 is pressed in order to provide for free passage from the mouthpiece 30 into the inflator tube 18 so that one can blow into the mouthpiece 30 and inflate the buoyancy compensator.

In addition thereto, the mouthpiece 30 can be used to breathe from the bag in certain situations by pressing the button 29. Also, the entire device can provide for a relief of pressure by pressing on button 29 and allowing air to flow through the mouthpiece 30 in a manner whereby air can escape.

It has also been customary sometimes to provide for a dumping of the buoyancy compensator pressure by other means. To this end, an overpressure valve 34 is provided. The overpressure valve 34 is attached by means of a flange 36 to the fabric 12 of the buoyancy compensator. In this manner, flow can take place through the opening 38. The overpressure valve in effect is a mushroom or poppet valve that drives open when pressures are exerted within the buoyancy compensator beyond the pre-established required pressures.

Looking more particularly at the outer configuration of the buoyancy compensator, it can be seen that the fabric 12 has been stitched with stitches 40 along the edge regions thereof to provide a side wall 42. The side wall 42 is stitched to a major outer portion 44 and an inner portion 46. The outer portion 44 and inner portion 46 provide for an overlayment to encompass a bladder 48 that is seen in greater detail in FIGS. 6, 7, 8 and 9.

In FIGS. 6, 7, 8 and 9, the bladder is shown in its opened an folded condition.

The inner portion 46 is of a smaller interior circumference at the arcuate shoulder portion 50 than the outer portion 44 is within the shoulder region 52. Thus, the interior and exterior portions 50 and 52 allow for a particular configuration without the bending and crimping that is known in the prior art. In particular, this configuration is established so that a curve of even and arcuate conformation is provided to the inner portion 50 and the outer portion 52 as connected by the side wall 42.

The outer portion 44 and inner portion 46 are configured to conform to a user's shoulder area with the rounded inner portion of the shoulder portion 50 and the outer portion 52. These respective outer and inner portions 52 and 50 allow for shoulder movement and arm movement within the arm opening 54. The arm opening 54 is a large interior opening providing substantial freedom of movement. Furthermore, the thin walled dimensions of the wall 42 joining the outer portion 44 and inner portion 46 of the side wall 42, provide for a very close tolerance to the entire buoyancy compensator without expanding and billowing it out.

Looking particularly at the opening 54, it can be seen that the lower portion thereof is banded or spanned by an expandable side panel 56. The expandable side panel 56 comprised a spandex elastic backing 58 and a pleated or corrugated panel portion 60. The pleated or corrugated side portion 60 has a plurality of ridges 62 and depressions 64. These respective ridges 62 and depressions 64 allow for expansion by permitting the spandex elastic side panel portion 58 to stretch and at the same time allow the opening and closing of the depressions 64 forming the pleats.

The side panels 56 serve to hold the lower portions of the side walls 42 in close relationship to a user's body and at the same time permit outward expansion for variously configured users and various amounts of air that are implaced within the buoyancy compensators. The joindure of the side walls 42 by the expandable side panel 56 can be substituted by way of a strap or beltlike material between the edges of the side walls.

As an alternative to panels 56, an adjustable belt can be used with or without the expandable side panels. This adjustable belt can be used with a buckle and a non-elastic side panel like panels 56. The buckle can allow for adjustment of the belt in its attached mode to the side walls 42. This attached mode allows for expansion and contraction of the side walls in a manner permitting adjustment when the side panels 56 are not utilized. However, in most embodiments, users will prefer the side panels 56, unless they want an absolutely tight fit by having the buckles and belt cinched up, thereby pulling the buoyancy compensator in a tightened mode into a diver's body.

Looking more particularly at the bladder 48, it can be seen that it is a unitary bladder having two back portions 72 and 74. The back portions 72 and 74 form a cutout 76 that is received in overlying relationship to a recessed space 80 within the back portion. The space 80 forms a depression on either side of back pockets 82 and 84 of the outer material 12.

The two back portions 72 and 74 join two front portions 86 and 88 of the bladder. These two front portions 86 and 88 comprise members that overlie a person's chest and fit within the frontal pocket areas 87 and 89 that are generally shown as the frontal areas within the front wall portions.

The foregoing also define a neck space 90. The neck space 90 is such that it forms a yoke or space 94 of the buoyancy compensator. The yoke area 94 fits around a user's neck in a manner whereby it provides space for a user to turn one's head and retain sufficient movement and not be discomforted by undue expansion of the yoke area 94.

The bladder 48 with its frontal portions 86 and 88 and back portions 72 and 74 is configured in a manner whereby it fits snugly within the pockets of the outer material 12 of the buoyancy compensator. The configuration is matched so that the neck space 90 fits within the yoke of the material comprising the outer material of the buoyancy compensator. In effect, the entire device conforms to a generalized H with a cross member 96 forming the cross portion of the H.

The cross portion of the H 96 is particularly adaptable for seating within the rear of the space or yoke 94. It is configured to not rise up and bind a person's neck as in the prior art buoyancy compensators. This is due to not only the configuration of the buoyancy compensator in its flattened condition, but also the internal features of the bladder, as will be enunciated hereinafter.

The bladder has gussets in the form of gussets 98 that generally conform to the internal portion of the bladder. These gussets 98 comprise a rib, elongated web, or spanning member 100.

The rib, elongated web, or spanning member 100 is sealed to the bladder by means of an upper seal and a lower seal respectively 102 and 104. The upper and lower seals are such that they are bonded to the material of the bladder in any suitable manner. In this particular instance, the seals 102 and 104 are heat sealed to a plastic material 106 forming the main bladder material. This plastic material 106 can be any suitable material such as a urethane, nylon, or other plastic material allowing for a heat setting of the seals 102 and 104 thereto.

In order to prevent tearing of the seals 102 and 104 along the length of the rib 100, an enlarged portion 108 and 110 respectively on the top and bottom seals 102 and 104 are utilized at either end of the seals. The enlarged portions 108 and 110 are such that they prevent a pulling away of the seals 102 and 104 along the length of the rib or elongated web. In effect, they strengthen the seal, thereby avoiding disassociation of the seal 102 from the plastic material 106.

Any suitable sealant, adhesive, sealing, heat setting, or other means can be used to bond the ribs 100 between an upper portion 112 and a lower portion 114 of the bladder. The goal to be achieved in the configuration is to provide a rib 100 or elongated web that is bonded to the bladder material 106 to establish an outer limitation of expansion of the bladder 48.

In effect, the rib 100 is a rib that prevents expansion beyond a certain portion so that the bladder 48 has an outer expanded limit dependent upon the height of the rib or elongated web. This creates channels or pockets 116 and 118 on either side of the rib 100. These channels or pockets 116 and 118 provide for sufficient buoyancy while at the same time preventing undue expansion of the buoyancy compensator in the chest and back regions. This is in great measure a substantial help with regard to both lateral arcuate expansion across the surface of the ribs, as well as preventing longitudinal expansion to a significant degree.

The outer portion of the buoyancy compensator bladder 48 is sealed with an outer seal around the surface thereof in the form of seal 120 and 122. These outer areas can be sealed either by heat setting or by providing an adhesive to the plastic bladder material. It should be noted however that any kind of bladder material can be used, so long as it incorporates the features of the structure as enunciated herein.

A preferred embodiment of the bladder has been found to be a particular plastic with the ribs 100 made of a urethane coated nylon fabric. The rib 100 made of the urethane coated nylon fabric is comprised of a 200 denier nylon, which can range to 400 denier, and can be a vinyl or any other heat sealable material. The coating is a coating on the surface, shown as coated surface 124 of the rib. This coated surface 124 of the rib can be of urethane material that can be then heat set along the seal 102 and 104. The heat set seal 102 and 104 flows into the plastic of the body 106 of the material forming the bladder.

The arcuate area over the shoulder of the bladder, namely the area within the interior portion 50 and the exterior portion 52 of the outer material, is provided with notches, pleats or insets generally shown as insets 126. These insets 126 are such that they will allow for a bending into a generally arcuate range over the shoulder in conformance with the outer material 52 and inner material 50 of the buoyancy compensator. In this instance, they are effectively shown as a heat set portion in the form of a linear seal 128 which bonds the upper and lower portions of the material, namely, portions 112 and 114 together. The linear crimped pleats that form the linear seal terminate in a bulbous or expanded portion 130. The bulbous portions are such that they provide for a reinforcement at the particular point where the upper and lower material 112 and 114 would expand inordinately and rip the linear seal 128.

The entire area provides a depression shown as depression 132. This depression 132 in effect pulls in the material so that it does not unduly expand into the shoulder area around the inner and outer portions respectively 50 and 52 of the outer material 12.

The seal 128 with the expanded portions 130 provide a reinforcement to effectively create a reinforced pleat inset or notch to allow the portion of the bladder thereat to conform in an arcuate manner. Any particular type of seal can be utilized, such as a heat seal, an adhesive, or any other suitable material to bind the bladder material 106 as to the upper portion 112 and the lower portion 114.

The buoyancy compensator bladder material 106 can be substituted whereby the entire material is made from a coated nylon fabric. For instance, the previous urethane coated nylon fabric as mentioned, can be utilized for the entire bladder material 106. In this manner, in some applications there is sufficient strength so that the nylon coated fabric as coated with the urethane can provide strength and at the same time be heat sealable along the inner surfaces such that seals 102 and 104 can be effectuated in a sealed relationship.

Furthermore, the entire outer material 12 and bladder material 106 can be substituted by a completely integral buoyancy compensator having only one cavity without the bladder. In this manner, the outer material 12 would be substituted by the urethane nylon fabric and would then be heatset on the inner urethane coated side, along seals 102 and 104 with ribs. Also, the shoulder area with the linear bladder seal 128 and expanded protuberance 130 would be included integrally and would be externally visible. In such a manner, a less expensive buoyancy compensator can be formed without the requirement of the inner bladder in some cases, depending upon usage, buoyancy requirements and general strength requirements.

Looking at the outer configuration of the buoyancy compensator, it can be seen that waist straps 134 and 136 have been shown. The waist straps 134 and 136 are held together by a buckle 138. The buckle 138 is a buckle which has a handle on it which cinches on the waist strap 136 to secure it thereto. In addition thereto, a second strap 140 can be utilized in conjunction with other straps to hold the buoyancy compensator in place.

A feature of this invention are the elastic mesh drainage vents 142 and 144 respectively at the front and the back of the pockets. These drainage vents 142 and 144 allow for water to be drained through the bottom of the pockets outwardly. They furthermore provide air circulation into the buoyancy compensator so that rot and mold and other deleterious attendant materials with moisture do not create a problem. The elastic mesh, which can be Spandex, allows expansion and contraction.

A backpack inset pocket 146 is shown. The packpack inset pocket has a side wall 148 which circumscribes the backpack inset pocket 146. At the top of the backpack inset pocket 146, an elastic mesh drain and air vent 150 are provided. This drain and air vent allows the moisture around the backpack that is seated within the pocket 146 to be drained. The backpack is secured through openings 152 and 154 to be held against the pocket 146.

The backpack incorporates a first pocket 156 on the left hand side of the user. This first pocket 156 has an elastic mesh frontal drain 142 as shown previously. It also incorporates a flap 158 secured by a velcro tab 160. The flap 158 folds down and allows for a pocket that is covered by a flap in conjunction with an elastic mesh material 162 of the front of the pocket. The pocket covers an emergency inflator formed as a $CO_2$ cartridge 164 and a pullcord 166 attached to a firing actuator 168. When the pullcord 166 is pulled downwardly, it fires the $CO_2$ cartridge 164 by causing the pin of the firing actuator 168 to puncture the $CO_2$ cartridge. This allows the flow of gas into the buoyancy compensator through an opening of the actuator 168 that passes into the bladder 48 of the buoyancy compensator.

The velcro tab 160 can be used to engage a series of tangs 170 on the inside of the flap 158 which secures the velcro tab 160 to the tangs 170.

A second pocket 172 having a velcro tab 174 with tangs 176 on an upper flap 178 is shown. This pocket also comprises an elastic mesh portion 180 to allow drainage similar to the mesh portion 162. The elastic mesh also circumscribes the pocket 172 in a manner to provide for drainage both laterally and on the bottom. The elastic mesh provides greater pocket expansion and contraction, so that various articles can be emplaced in the pocket.

The pocket 172 has a particularly unique front wall 180. The front wall 180 has a sloping top edge portion 182. The sloping top edge portion 182 provides for easy access and the holding of a second stage regulator which can be used as a backup regulator that is generally referred to as a term of art in the diving industry as an octopus.

The octopus or backup second stage regulator has a hose which comes out from the downwardly sloping edge portion terminating in a diminished side wall 184. The diminished side wall 184 is below the surface of the frontal wall 180 at its highest portion wherein the wall 80 fairs down into the diminished side wall 184. This allows for hoses to extend over the diminished side wall when the flap 178 is closed, securing the octopus therein. This thereby allows for a retention of the octopus in the pocket while at the same time allowing the hoses to extend therefrom in their normal manner.

When utilization of the octopus is desired, the flap 178 need merely be pulled upwardly. This allows the removal of the octopus in its completely connected relationship with the hoses extending over the top of the diminished side wall edge 184, and in connected relationship with the first stage regulator for immediate use. This enhances the entire operation of the buoyancy compensator and allows for ready and facile removal from the buoyancy compensator of the octopus and provides for the storage thereof within the pocket 172.

The rib 100 can be substituted by means of a number of webs or spandrels between the upper portion 112 and lower portion 114. In effect, the rib 100 need not be sealed or adhered in a continuum between seals 102 and 104. There can be spaces and interruptions along the length thereof between pockets or channels 116 and 118. The criteria to be maintained is a means for curtailing the undue expansion or protrusion of the respective outer surfaces and inner surfaces 112 and 114 with respect to each other.

As can be seen, this invention is a substantial step over the prior art, inasmuch as it provides for unique pockets, a particularly enhanced outer material, gussets which prevent undue expansion, as well as pleats for conformation of the entire buoyancy compensator and bladder to a user's body to prevent undue expansion and protrusion thereof. The invention serves to effectuate improved human factors, ergonomics, human engineering considerations and fit. As a consequence, this invention should be read broadly as to buoyancy compensators with regard to the following claims.

I claim:

1. A buoyancy compensator for providing buoyancy trim to an underwater diver comprising:

a first outer cover conforming to a user's chest area and back area and having means for attaching a diver's backpack thereto;

a bladder internally of said outer cover conforming generally to the front and rear portion of said buoyancy compensator having a chamber therein that has been divided by connecting the front and back walls of said chamber into a plurality of cummunicating pockets divided by a rib adhered to said front and back walls extending within at least a portion of the front of said buoyancy compensator and the rear of said buoyancy compensator;

pleats within the shoulder region of said buoyancy compensator formed within said bladder to allow folding of said bladder in conformation to a user's shoulder;

said bladder is formed of a plastic material; and, said rib is heat set into said plastic material with reinforcing enlargements at the end of said heat set to prevent tearing of said rib along said heat set.

2. The buoyancy compensator as claimed in claim 1 further comprising:

said pleats of said buoyancy compensator being heat-set into said bladder in the form of a linear seal terminating in an enlarged portion to prevent tearing along said linear seal.

3. The buoyancy compensator as claimed in claim 2 further comprising:

inflation means having a mouthpiece attached thereto and connected to said buoyancy compensator bladder through said outer material.

4. The buoyancy compensator as claimed in claim 2 further comprising:

at least one pocket on said buoyancy compensator in the frontal area thereof.

5. The buoyancy compensator as claimed in claim 4 further comprising:

drains within the base of said buoyancy compensator in the outer material in the form of an open elastic mesh cloth.

6. The buoyancy compensator as claimed in claim 4 wherein:

said pocket has a flap with means for attaching said flap to the frontal portion thereof; and, at least one side wall having a lesser height dimension than the frontal portion so that a second stage regulator can be implaced within said pocket and the hose therefrom allowed to extend from said pocket when said flap is covering said hose and said second stage regulator.

7. A buoyancy compensator having the capability of increasing or decreasing relative buoyancy of an underwater diver dependent upon the air therein adaptively formed with a neck portion forming a yoke around a user's neck and a vest portion on either side of one's chest with a rear portion adapted for placement at least in part on each side of a backpack for a diver wherein the improvement comprises:

a frontal bladder portion having at least two communicating chambers divided at least in part by an internal spanning member formed as a portion of the bladder connecting the front and back walls of said bladder to form said plurality of chambers, means to receive a backpack for diving tanks on the rear portion of said backpack;

covering means overlying said bladder to control the expansion thereof;

a plurality of chambers formed in the rear of said buoyancy compensator bladder freely communicable with said front chambers, wherein said bladder is formed from a plastic material which has been heat set to provide at least in part said spanning member;

heat set pleats around the shoulder portion thereof; and said pleats being formed as linear heat set pleats terminating in an expanded heat set area in order to crimp and retain the buoyancy compensator shoulder configuration around said shoulder.

* * * * *